United States Patent [19]

Cameron et al.

[11] Patent Number: 4,995,886

[45] Date of Patent: Feb. 26, 1991

[54] METHOD OF ASSEMBLING A CONTROLLED SEAL FOR AN EXPULSION FUSE

[75] Inventors: Frank L. Cameron; George A. Smith, both of N. Huntingdon, Pa.

[73] Assignee: Westinghouse Electric Corp., Pittsburgh, Pa.

[21] Appl. No.: 540,986

[22] Filed: Jun. 20, 1990

Related U.S. Application Data

[62] Division of Ser. No. 445,057, Dec. 4, 1989, Pat. No. 4,952,900.

[51] Int. Cl.[5] ..... H01H 69/02

[52] U.S. Cl. ..... 29/623

[58] Field of Search ..... 29/623; 337/217, 202, 337/219, 220, 221, 248–252

[56] References Cited

U.S. PATENT DOCUMENTS

| | | | |
|---|---|---|---|
| 2,590,524 | 3/1952 | Edwards . | |
| 3,333,336 | 8/1967 | Cameron et al. | 29/623 |
| 3,401,243 | 9/1968 | Upton, Jr. et al. . | |
| 3,401,244 | 9/1968 | Patterson . | |
| 3,401,245 | 9/1968 | Cameron . | |
| 3,401,246 | 9/1968 | Patterson . | |
| 3,855,563 | 12/1974 | Cameron et al. | 337/178 |
| 4,208,787 | 6/1980 | Luck et al. | 29/623 |
| 4,746,381 | 5/1988 | Parker et al. | 29/623 |

FOREIGN PATENT DOCUMENTS

| | | | |
|---|---|---|---|
| 3226800 | 1/1984 | Fed. Rep. of Germany | 29/623 |

*Primary Examiner*—P. W. Echols
*Attorney, Agent, or Firm*—M. J. Moran

[57] ABSTRACT

A high voltage circuit interrupter, having telescopic tubular insulating and conducting casings, contains an expulsion end sealing construction which hermetically seals and controls the expulsion rate of the interrupter. The expulsion end includes a sleeve, a thin, rupturable diaphragm affixed against the sleeve by cyanoacrylate cement, and an end cap. Epoxy cement is applied into the cap so that the space between the diaphragm and the end cap are filled forming a sealant layer therebetween. A main ferrule secures the strain element, and an auxiliary ferrule secures both the main ferrule and the end cap onto the end of the tubular insulating casing.

2 Claims, 1 Drawing Sheet

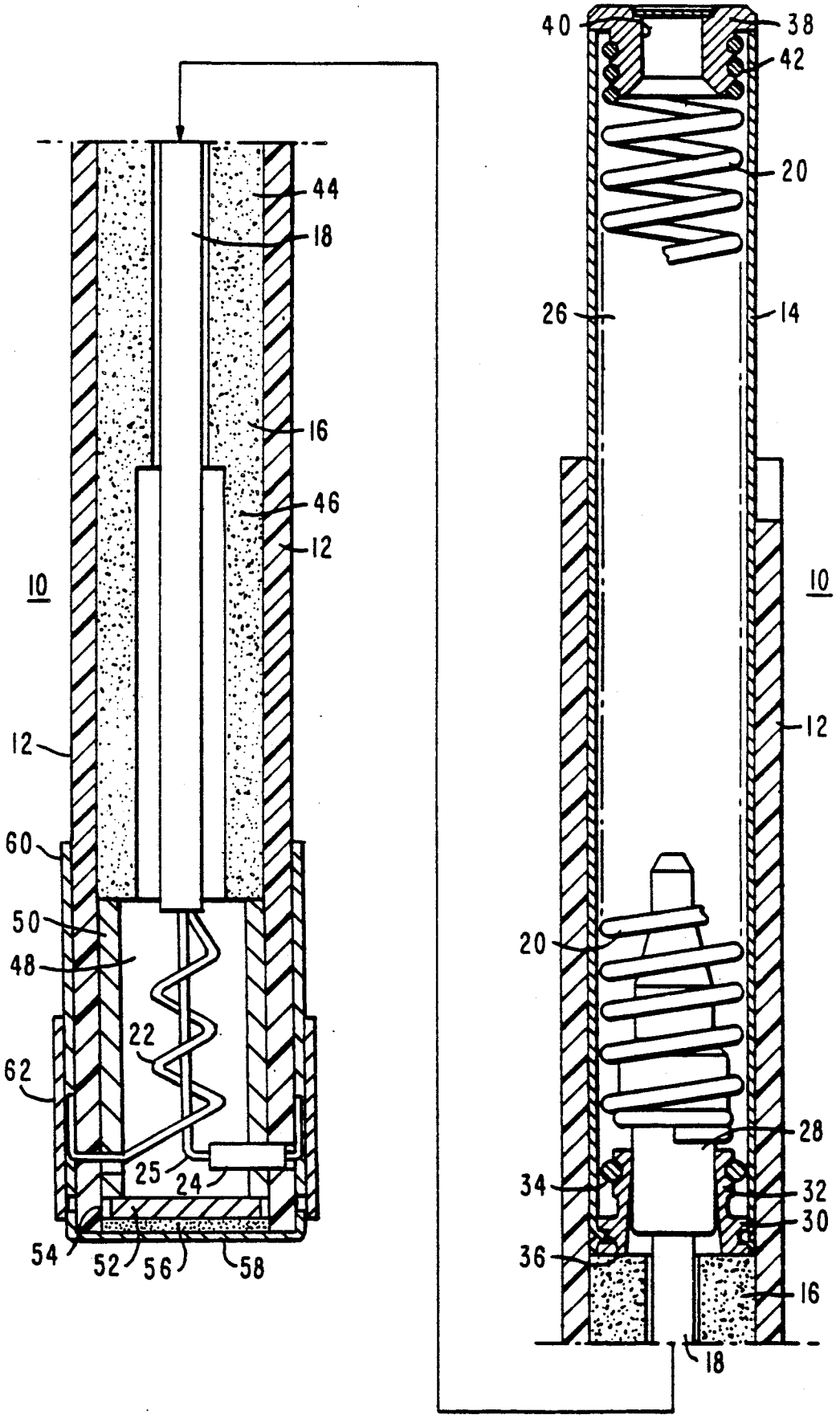
40
38
42
20
44
18
26
14
16
46
12
10
10
12
12
60
50
48
20
22
62
28
25
24
34
32
30
36
16
54
52
56
58
18

METHOD OF ASSEMBLING A CONTROLLED SEAL FOR AN EXPULSION FUSE

This is a division of application Ser. No. 07/445,057 filed Dec. 4, 1989, now U.S. Pat. No. 4,952,900.

BACKGROUND OF THE INVENTION

1. Field of the Invention

The invention relates to a high voltage circuit interrupter of the high capacity fuse type, and more particularly to a sealing construction and method for assembling the sealing construction on the end of such a device.

2. Description of the Prior Art

High voltage expulsion fuses are current interrupter devices which are operated to open a circuit by means of expelling gases and metallic vapors at high velocity and pressure, which are created in extinguishing an arc initiated in the device by a fault current.

Circuit fuses, or interrupters of the type involved in this invention are disclosed in U.S. Pat. Nos. 2,590,524; 3,401,243; 3,401,244; 3,401,245; 3,401,246; and 3,855,563. These devices of these patents are generally sealed at both the upper and lower ends. The sealing at at least the end near the fuse element is generally accomplished by employing a vinyl cap which encloses the opening and which is affixed by an epoxy cement.

These devices of the prior art and that of the invention are generally used outdoors in utility systems, with high voltage loadings and possibly different current ratings. Regardless of the magnitude of the voltage loadings and the current ratings of these types of devices, it is desirable to provide an undamageable and effective seal at the end of the device near the fuse element. This seal has to endure atmospheric conditions where moisture leaking inside the fuse generally tends to cause the arc-extinguishing material to swell thereby restricting movement of the elongated rod.

Movement of this rod through the arc-extinguishing material is essential in order to extinguish the arc initiated by the melting of the fuse element at the end of the rod. The extinguishing action of the arc creates the gases and vapors in the device. At a low fault current interruption of the device relative to its rating, the internally generated gas and vapor pressures are low. At this low fault current level the seal must remain intact in order to allow enough gases and vapors to build up to effectively extinguish the arc. At high current interruptions of the device relative to its rating, the internally generated gas and vapor pressures are high and are developed at a high rate of speed. At this high fault current level the seal must be reliably and consistently rupturable so that excessive and disruptive pressures are not contained within the fuse resulting in an explosive condition. It is essential that the seal at the fuse end be capable of being blown off to vent these pressures.

One of the major drawbacks of the enclosure cap used at the end of the fuse to seal the present day devices is that this cap is affixed with varying amounts of epoxy cement. This method of assembling a seal at the end of the fuse may result in both an ineffective sealing condition and/or an intolerable condition in that the end is either plugged up preventing the escape of the pressures at the high fault current levels or the cap is detached prematurely from the fuse end at the low fault current levels.

There is a need therefore for an improved high voltage circuit interrupter or fuse of the expulsion type which maintains an effective sealing condition under normal current carrying operations or under a low fault current interruption, regardless of the atmospheric conditions, but which sealing condition is readily interrupted at a high fault current level which exceeds the maximum allowable loading value for the system.

More particularly, there is a need for an improved sealing construction and method for assembling such sealing construction for a high voltage circuit interrupter or fuse of the expulsion type, which sealing construction is reliably and consistently rupturable at high fault current levels.

There is a further need for such a circuit interrupter to have an hermetically and mechanically controlled seal which is consistently rupturable at high fault current levels so that excessive and disruptive gas and/or vapor pressures are not contained in the interrupter thereby presenting a detrimental explosive condition.

SUMMARY OF THE INVENTION

These and other needs are satisfied by the invention which is directed to a sealing construction and a method for assembling the sealing components at the fuse end of a high voltage circuit interrupter of the expulsion type. The device includes telescopic tubular insulating and conducting casings for carrying a body of arc-extinguishing material and an elongated contact rod with a helical tension spring between the end of the tubular conducting casing and the elongated contact rod. The body of arc extinguishing material is positioned in the tubular insulating casing such that an open end portion is formed at the expulsion end of the interrupter. A sleeve is seated in place within this end portion of the insulating casing with a fuse element, an arcing pin, and a strain element extending through the insulating casing and the sleeve. A relatively thin easily rupturable diaphragm is placed in the expulsion end against the sleeve, and cement is inserted around the periphery of the diaphragm. Epoxy cement is inserted into a cap and the cap is placed on the end of the insulating casing. This epoxy cement fills the space existing between the diaphragm and the end cap, and any other voids which may exist between the end cap and the diaphragm. A layer of epoxy cement is formed between the diaphragm and the end cap and provides the required additional strength to back-up the diaphragm and cooperates with the epoxy cement around the diaphragm to adequately seal off the fuse end. The end cap is secured to the end of the tubular insulating casing by an auxiliary ferrule which also retains a main ferrule holding the fuse element and the strain element in place.

BRIEF DESCRIPTION OF THE DRAWING

The single FIGURE of the drawing is a vertical sectional view of a high voltage interrupter of the expulsion fuse type.

DESCRIPTION OF THE PREFERRED EMBODIMENT

In the drawing, an expulsion fuse is generally indicated at 10 and comprises a tubular insulating casing 12, a tubular conducting casing 14, a body 16 of arc-extinguishing material such as boric acid, a contact rod 18, biasing means such as a helical tension spring 20, and fusible means which includes fuse element 22, arcing pin 24, and strain element 25.

The tubular insulating casing 12 is composed of a suitable insulating material, such as filament wound glass epoxy. The tubular conducting casing 14 is an elongated member composed of a metal having good electrical conductivity such as copper. The lower end portion of the casing 14 is snugly fitted within the upper end portion of the casing 12 and has a purpose of providing a chamber 26 in which the helical spring 20 is disposed and into which rod 18 is retracted by the spring when fuse element 22 melts under an excess current rating.

The drawing shows a closed circuit position for contact rod 18. The upper end portion of rod 18, includes an enlarged head 28, which is seated within an annular conductor 30. Conductor 30 comprises a plurality of spaced fingers 32 extending upwardly from the body of the conductor 30, and an annular coil spring 34 which holds the fingers 32 in good electrical contact with the enlarged head 28 of contact rod 18.

As shown in the drawing, annular conductor 30 includes a peripheral groove 36 in which an inturned annular end portion of casing 14 is embedded in a form-fitted manner. Such an embedding process may be accomplished by Magneforming® which is a method involving magnetic forming described in U.S. Pat. No. 3,333,336 issued on Aug. 1, 1967.

The upper end of conducting casing 14 includes an end cap 38 having a central bore 40. The upper end portion of helical spring 20 is secured at 42 to the outer surface of end cap 38, and the assembly of the end cap and spring is, in turn, secured in place within the casing 14 by a form-fitted joint, such as by the aforementioned Magneforming® process.

The body 16 of arc-extinguishing material is a single, elongated tubular member which is disposed adjacent to annular conductor 30 along the inner wall of casing 12. The upper end portion 44 of body 16 has a bore with a smaller diameter than a lower portion 46 of body 16. Adjacent to body 16 in the lowermost portion of casing 12 is a bore 48, more about which will be discussed hereinafter. As is known in the art, this construction facilitates extinguishment of an arc of both low and high current densities, which occurs when helical tension spring 20 retracts the rod 18 upwardly from the closed circuit position as shown in the drawing to an open circuit position. The preferred composition of the body 16 is boric acid. As the rod moves through body 16, the arc initiated by a fault causes water vapor and gases to be emitted, which condition creates a turbulent, high-pressure deionizing environment in fuse 10.

Fuse element 22 is preferably composed of a material, such as silver, having a high coefficient of electrical conductivity. Strain element 25 is primarily used to retain rod 18 in the lowermost closed circuit position as shown in the drawing, and may be composed of a material having a relatively low coefficient of electrical conductivity and high strength such as a nickel-chromium alloy. When a current overload of sufficient magnitude passes through fuse 10, fuse element 22 melts. The current then selects the alternate route through strain element 25 which has a higher electrical resistance, thereby also melting strain element 25. This relieves the retaining force on contact rod 18, where spring 20 retracts rod 18 upwardly in the drawing in an open circuit position.

These above components and their interrelationship and operation are well known in the art, and can particularly be found in the aforesaid U.S. Pat. No. 3,855,563 issuing on Dec. 17, 1974 to Frank L. Cameron and Harold L. Miller, the former inventor being a co-inventor of the present invention.

The teachings of the invention will now be given with particular reference to the lower left hand portion of the drawing.

Below body 16 of arc-extinguishing material and abutting the inner wall of insulating casing 12 is a tubular conductor or sleeve 50. This lower open end portion of casing 12 forms a fuse end for expulsion fuse 10 and contains fuse element 22 and arcing pin 24.

This sleeve 50 in the fuse end is composed of a metal having good electrical and thermal conductivity, such as copper or brass, with brass which is easily machinable, and relatively inexpensive being preferred. Sleeve 50 protects the inside of organic insulating casing 12 which generally is fiberglass from heat during arcing and positions body 16 of arc-extinguishing material in casing 12.

A diaphragm member 52 in the form of a circular disk is seated in place against the outer surface of sleeve 50. Diaphragm member 52 is composed of a metal which is easily rupturable, such as copper. The thickness of diaphragm member 52 is preferably 0.005 inches, and is affixed to sleeve 50 by a thin layer of cyanoacrylate cement, preferably Loctite Cement No. 430, which is easily available in the market. This thin layer of cement indicated at 54 in the drawing, preferably is laid around the periphery of diaphragm member 52 and quickly affixes diaphragm member 52 in place against sleeve 50. This thin layer 54 of cement acts as a sealant to close off bore 48 of insulating casing 12. To further seal off bore 48, there is formed an additional layer or film of epoxy cement indicated at 56 which covers diaphragm member 52 and which is located in bore 48 located at one extreme end of casing 12.

Between end cap 58 and diaphragm member 52, a space is generally formed, and this epoxy cement at 56 acts to fill this space and any other voids existing at the end of casing 12, between diaphragm member 52 and end cap 58. This layer or film 56 of cement along with layer 54 of cement provides a back-up seal of controlled mechanical strength, for the fuse end of expulsion fuse 10.

End cap 58 is composed of a relatively inexpensive durable material such as polyvinyl. This type of material withstands inclement weather and is waterproof. It is not essential for this material to have good electrical conductivity characteristics in that the terminal for electrical conduction is formed by a main ferrule 60 and an auxiliary ferrule 62. Ferrules 60 and 62 are annular members and are composed of metal, such as copper.

As is shown in the drawing, main ferrule 60 abuts the exterior surface of casing 12, and auxiliary ferrule 62 retains end cap 58 and ferrule 60 by being form-fitted against the outer surface of end cap 58 and ferrule 60. This form-fitting process may be accomplished by the Magneforming process hereinbefore described.

Arcing pin 24 extends through sleeve 50 and casing 12, and abuts ferrule 60 which in turn abuts ferrule 62 as shown to the extreme lower left hand portion of the drawing. Also as shown, strain element 25 extends through ferrule 60 and is held in place by ferrule 62.

In the assembly of the circuit interrupter 10 involving the components of the invention, fuse element 22, strain element 25, arcing pin 24, and main ferrule 60, are located as shown in the drawing. Diaphragm member 52 is inserted against sleeve 50. A thin layer 54 of cement is laid around the periphery of the diaphragm member 52. Epoxy cement is then ladled into end cap 58, and end cap 58 is placed onto the extreme end of casing 12. This cement fills any voids remaining between the end of casing 12 and cap 58 and between end cap 58 and diaphragm 52, and forms an extra layer or film of material to seal the fuse end. This provides a back-up seal of controlled mechanical strength. Any excess cement is forced out of cap 58, which is readily wiped away. Ferrule 62 is placed onto casing 12 to overlap both cap 58 and ferrule 60. Interrupter 10 is now placed upright on cap end 58 and the epoxy cement is allowed to harden.

Under normal operating conditions, interrupter 10 is effectively sealed at its expulsion end through the employment of diaphragm 52 and the cements indicated at 54 and 56 in combination with end cap 58. When a low fault current occurs, fuse element 22 melts, and the current travels through strain element 25 which also melts, resulting in arcing between rod 18 and arcing pin 24. The force of spring 20 pulls rod 18 through body 16 of arc-extinguishing material. Heat produced by the arc causes gases and vapors to be formed. Under these low fault current conditions, diaphragm member 52 with end cap 58 remains at the end of interrupter 10 so that a sufficient amount of gases and vapors are collected in order to adequately extinguish the arc in the fuse end. If, and when, this pressure exceeds an allowable amount, then diaphragm 52 easily ruptures allowing the pressure to break through layer 56 and removal of cap 58. At a high fault current, the intensity of the heat causes the gases and vapors to form at a higher rate and at a higher pressure. Under these conditions, diaphragm member 52 easily ruptures, allowing the pressure of the gases and vapors to break through the film or layer of epoxy 56 and end cap 58 to be removed from the expulsion end.

The drawing shows an arrangement of fuse element 22, arcing pin 24, and strain element 25 for a certain amperage rating, however, it is to be understood that the invention operates just as effectively for a circuit interrupter with any amperage rating and which undergoes either a low fault current or a high fault current.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A method of assembling a sealing construction for an electric circuit interrupter, and having a controlled mechanical strength, the steps comprising:

providing a tubular insulating casing with an inner wall, an expulsion end, a fuse end, and a sleeve in said fuse end, inserting a diaphragm in said expulsion end against said sleeve, applying a layer of cement around the periphery of said diaphragm between said diaphragm and said inner wall of said tubular insulating casing to affix said diaphragm and to seal said expulsion end, providing an end cap to enclose said expulsion end, and prior to placing said end cap onto said expulsion end, applying epoxy cement into said cap in order for said cement to fill the space existing at said expulsion end between said diaphragm and said end cap and any voids existing between said end cap and said tubular insulating casing.

2. A method according to claim 1, the steps further comprising:

positioning said electric circuit interrupter in an upright position on said end cap, and allowing said epoxy cement to harden.

* * * * *